United States Patent [19]

Muthenthaller

[11] 4,113,164

[45] Sep. 12, 1978

[54] STAPLER

[75] Inventor: Gustav Muthenthaller, Milan, Italy

[73] Assignee: Kores S.p.A., Milan, Italy

[21] Appl. No.: 823,963

[22] Filed: Aug. 12, 1977

Related U.S. Application Data

[63] Continuation of Ser. No. 718,041, Aug. 26, 1976, abandoned.

[30] Foreign Application Priority Data

Mar. 4, 1976 [IT] Italy ..... 20856 A/76

[51] Int. Cl.[2] ..... B25C 5/02

[52] U.S. Cl. ..... 227/124; 227/127; 227/155

[58] Field of Search ..... 227/120, 124, 127, 128, 227/155

[56] References Cited

U.S. PATENT DOCUMENTS

| | | | |
|---|---|---|---|
| 1,994,567 | 3/1935 | Cavanagh | 227/128 |
| 2,149,839 | 3/1939 | Cavanagh | 227/124 |
| 2,378,725 | 6/1945 | Paul | 227/155 |
| 2,381,192 | 8/1945 | Vancura | 227/128 |
| 2,801,414 | 8/1957 | Mueller | 227/127 |
| 3,103,012 | 9/1963 | Kohen et al. | 227/124 |

*Primary Examiner*—Granville Y. Custer, Jr.
*Attorney, Agent, or Firm*—Norman S. Blodgett; Gerry A. Blodgett

[57] ABSTRACT

Portable office stapler, having a flat box-like configuration with an approximately constant cross-section in the shape of a flattened cake of soap, having mechanical and covering functions, and comprising two parts, including a body containing all of the other moving members and a lid-button pivoted at the front and comprising most of the back for the box-like member, the latter transmitting between said lid-button and an anvil integral with the body all of the forces and reactions required for staple closing. At the front slit is provided for introducing sheets or layers to be stapled with the cooperation thereat of said anvil, a staple-carrying magazine, a feeder, a push-load plate, a hammer, and a staple closing plate. The drive for all of these members is produced by a button acting through a roller on the hammer at a contact location between one pin and the button-pressing zone and between a second pin and the hammer head.

4 Claims, 4 Drawing Figures

STAPLER

This is a continuation of application Ser. No. 718,041, filed Aug. 26, 1976, now abandoned.

BACKGROUND OF THE INVENTION

The present invention relates to a carrying box or housing type of manual portable stapler for offices and the like. Ordinary office staplers are well known and, as to structural implementation and handling, they have a common stem with a tool, such as pliers, tongs and the like, which have more aesthetic and functional characteristics as a workshop article than an office article. Additionally, in the scissors type of stapler, as the stapling operation produces a horizontal and vertical displacement of the anvil base on which the staples are closed, giving rise to difficulty in centering the stapling operation.

With these and other objects in view, as will be apparent to those skilled in the art, the invention resides in the combination of parts set forth in the specification and covered by the claims appended hereto.

SUMMARY OF THE INVENTION

This invention overcomes the above-mentioned disadvantages by using a box-like member for the mounting, operation, control and also for partial construction of the basic parts. This box-like member is shaped like a flat cake of soap of approximately constant cross-section, and is formed as a main body and trigger pieces. The stapling operation is carried out by depressing the trigger comprising the back portion of the box-like member, which trigger is swingable about a pin arranged at about the front end of the stapler. The staple feeder is provided with a pin which is located at the rear end of the stapler. The anvil rests on the lower base of the box-like member. The drive button operates on the staple-pushing hammer of the feeder by means of a roller located approximately on the central axis of the button which overcomes the resistance of a return spring. All of the primary structural members or elements, such as the sheet introduction slot, the anvil, the feeder, the hammer and the release button for the staple magazine are approximately parallel or aligned along the longitudinal axis of the box-like member, while all of the housings and or mountings thereof are arranged in directions which are orthogonal to the box member walls and the interior thereof.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
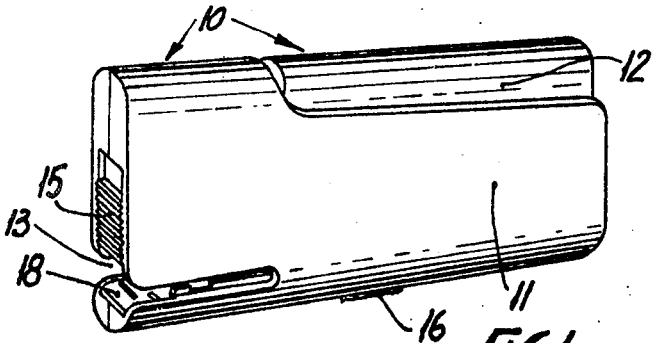
FIG. 1 is an external perspective view of the invention.

A box-like stapler 10 is made up of an elongated body 11 and main trigger 12, and is provided with a slit 13 for introducing sheets or the like to be assembled, a button 14 for releasing the magazine when unloaded, a door 15, and a slider 16 for anvil movement by a pin 17. A magazine 20 along the staples 21 is under the action of a pressure staple pusher 22 forming part of a feeder 19 pivoted at pin 25. The front wall 20' of the magazine acts as a stop for the staples.

Figure 2:
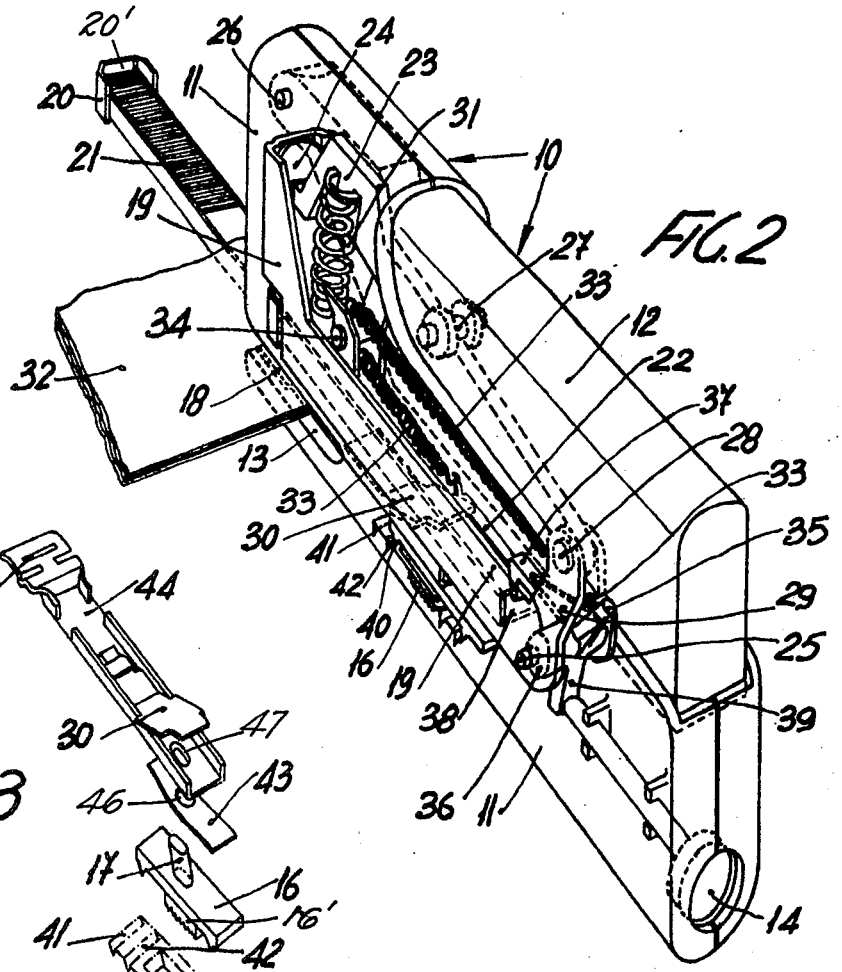
FIG. 2 is an enlarged perspective view of the invention showing the internal elements of the latter.
Figure 3:
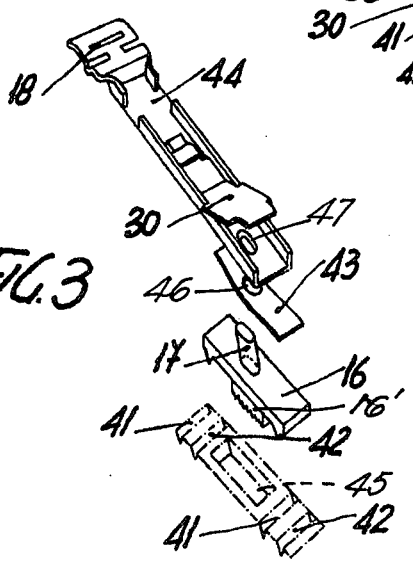
FIG. 3 shows the detail of the anvil in an exploded view.
Figure 4:
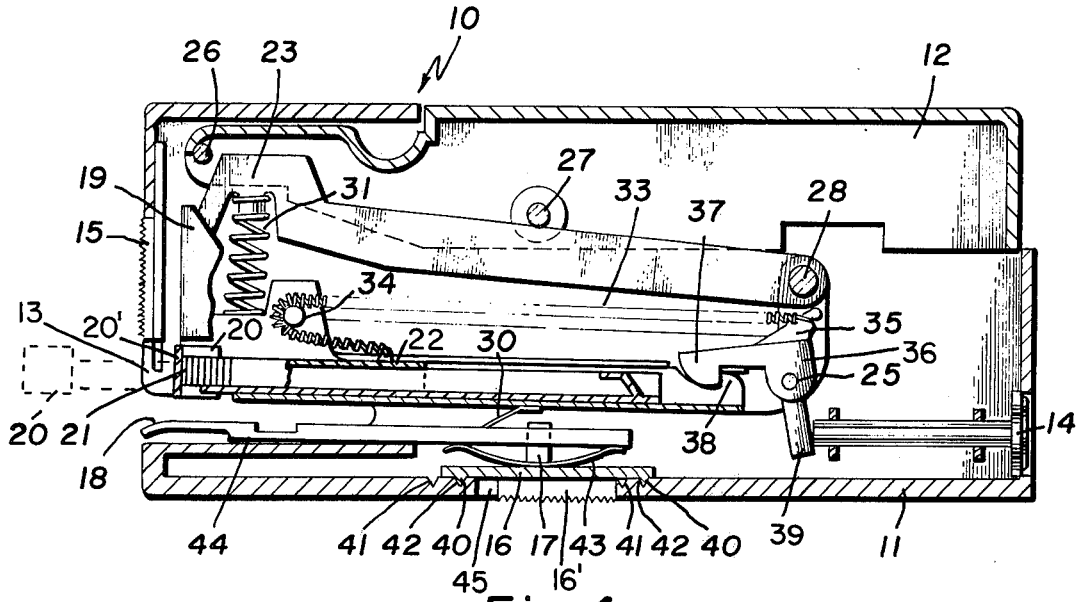
FIG. 4 is a vertical sectional view of the invention.

Referring particularly to FIGS. 2, 3, and 4, a hammer 23 is pivoted to a pin 28 in feeder tabs 29 and at the front end carries a staple driver or staple-closing plate 24 which coacts an anvil 18, the latter being located on the bottom of the main body 11. At the front, the trigger 12 is pivoted on a pin 26 which is integral with the main body 11 and which acts on the hammer by means of a roller 27. A helical spring 31 pushes the hammer against the feeder and the magazine 20 against sheets 32, thus overcoming the resistance of a flat return spring 30 which is integral with the body 44 of the anvil 18 (FIG. 3). By means of the pin 34, a single helical spring 33 pulls said pressure staple pusher 22 and, by means of an arm 35 integral with a lever 36 pivoted to pin 25, pushes a hook 37 integral with lever 36 on a tooth 38 of the magazine 20. This blocks the latter and through a lever 39 integral with lever 36 as a return spring for button 14. The anvil acts 18 is stabilized at its two positions by the fingers 40 of the slider 16 penetrating into the pair of slots 41 and 42 and by the action of a flat spring 43 interposed between said slider 16 and anvil 18, respectively. Slider 16 includes a projection 16' which extends through a lower opening 45 in the body. Pin 17 extends through apertures 46 and 47 in spring 43 and the body 44, respectively. By manually grasping the stapler sideways trigger 12, hammer 23 and accordingly feeder 19 are lowered, and the staples are propelled one after the other onto the anvil 18, thus providing for normal stapling. Upon pressing the buttom 14, the said lever 36 will rotate in a clockwise direction, releasing the magazine 20 which,; under the urging of the spring 33, will partially project from the front portion, the door 15 having been raised.

The present stapler operates by simple reciprocation of the trigger 12 and the body 11, the latter having structural and covering functions without any other external moving members or fasteners, such as screws, rivets and the like. The external surfaces are continuous and smooth, the said anvil 18 being held rigidly with the body of the stapler 10. Accordingly, the stapling operation is carried out at a steady state, the intrinsic properties of the plastic material are uniquely taken advantage of for the construction of the stapler 10, thus providing substantial advantages not only as to function, but also as to aesthetics.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

I claim:

1. A portable office stapler, comprising:

(a) a generally hollow main body having a front slot for receiving sheets to be stapled together and an opening above said slot, (b) a movable hammer above said slot, (c) an anvil below said slot, (d) a staple magazine slidably mounted within said body between an inner stapling position and an outer loading position wherein the forward end of said magazine extends through said opening beyond said body, said magazine having a stop at its forward end and a tooth at its rearward end, (e) a staple pusher slidably mounted in said magazine, (f) a lever rotatably mounted within said body and including a hook for engaging said tooth, (g) means for biasing said pressure plate toward said stop for maintaining staples placed in said magazine against said stop and for urging said magazine toward said loading position, said biasing means also being secured to said lever for urging said hook into engagement with said tooth for maintaining said magazine in said stapling position, and (h) a button slidably mounted on said body for engagement with said lever so that said button is biased by said biasing means acting through said lever toward a non-operative position and wherein movement of said button by an external force causes said lever to rotate against said biasing means for pulling said hook out of engagement with said tooth and thereby allowing the forward end of said magazine to be projected outside of said body by said biasing means.

2. A stapler as set forth in claim 1 comprising a pin rigidly attached to said main body and wherein said biasing means comprises a single tension spring looped around said pin, one end of said spring being attached to said staple pusher and the other end thereof being attached to said lever.

3. A stapler as set forth in claim 2, wherein said lever comprises a first arm projecting from said lever to which the other end of said spring is attached and a second arm projecting from said lever for engaging said button, said first and second arms and said hook all extending in the same general plane which is perpendicular to the axis of rotation of said lever.

4. A stapler as set forth in claim 1 comprising a door slidingly mounted on said body for movement into and out of closing position with said front opening.

* * * * *